US011193332B2

(12) United States Patent
Jelsma et al.

(10) Patent No.: US 11,193,332 B2
(45) Date of Patent: Dec. 7, 2021

(54) SLIDER COMPENSATED FLEXIBLE SHAFT DRILLING SYSTEM

(71) Applicant: Schlumberger Technology Corporation, Sugar Land, TX (US)

(72) Inventors: Henk Jelsma, Spring, TX (US); Bill DuBose, Jersey Villiage, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 49 days.

(21) Appl. No.: 16/556,444

(22) Filed: Aug. 30, 2019

(65) Prior Publication Data

US 2020/0087988 A1 Mar. 19, 2020

Related U.S. Application Data

(60) Provisional application No. 62/730,679, filed on Sep. 13, 2018.

(51) Int. Cl.
*E21B 17/06* (2006.01)
*E21B 7/06* (2006.01)
(Continued)

(52) U.S. Cl.
CPC ..... *E21B 7/068* (2013.01); *E21B 7/046* (2013.01); *E21B 17/18* (2013.01); *E21B 43/11* (2013.01); *E21B 43/14* (2013.01)

(58) Field of Classification Search
CPC . E21B 17/20; E21B 7/068; E21B 7/04; E21B 7/06
See application file for complete search history.

(56) References Cited

U.S. PATENT DOCUMENTS 2,731,414 A 1/1956 Binder, Jr.
2,808,109 A 10/1957 Kirk
(Continued)

FOREIGN PATENT DOCUMENTS

CN 102504292 A 6/2012
CN 105349166 A 2/2016
(Continued)

OTHER PUBLICATIONS

Alekseenko, O. P., Potapenko, D.I., Cherny, S.G., Esipov, D.V., Kuranakov, D.S., Lapin, V.N. "3-D Modeling of fracture initiation from perforated non-cemented wellbore", SPE J., vol. 18, No. 3, 589-600, 2013.
(Continued)

*Primary Examiner* — Kristyn A Hall
(74) *Attorney, Agent, or Firm* — Michael L. Flynn

(57) ABSTRACT

Systems and methods presented herein include a drilling system that includes a deflecting device having an internal passage extending therethrough, and a flexible drilling assembly configured to extend through the internal passage of the deflecting device, and to create a perforation lateral tunnel in a wellbore. The flexible drilling assembly includes a flexible drive shaft configured to rotate relative to the internal passage of the deflecting device. The flexible drilling assembly also includes a cutting bit disposed at a first axial end of the flexible drilling assembly. The flexible drilling assembly further includes a slider tube disposed at a second axial end of the flexible drilling assembly. In addition, the flexible drilling assembly includes a slider radially disposed within the slider tube. The slider is hydraulically configured to compensate for expansion and compression of the flexible drive shaft while the perforation lateral tunnel is being created in the wellbore by the flexible drilling assembly.

20 Claims, 9 Drawing Sheets

(51) Int. Cl.

| | |
|---|---|
| ***E21B 7/04*** | (2006.01) |
| ***E21B 17/18*** | (2006.01) |
| ***E21B 43/11*** | (2006.01) |
| *E21B 43/14* | (2006.01) |

(56) References Cited

U.S. PATENT DOCUMENTS

| | | | | |
|---|---|---|---|---|
| 3,282,337 | A | | 11/1966 | Pye |
| 3,336,221 | A | | 8/1967 | Ralston |
| 3,553,099 | A | | 1/1971 | Savage |
| 3,704,750 | A | | 12/1972 | Miles |
| 3,878,884 | A | | 4/1975 | Raleigh |
| 3,892,274 | A | | 7/1975 | Dill |
| 4,007,797 | A | * | 2/1977 | Jeter ..... E21B 4/00 175/26 |
| 4,032,460 | A | | 6/1977 | Zilch et al. |
| 4,036,732 | A | | 7/1977 | Irani et al. |
| 4,046,668 | A | | 9/1977 | Farcasiu et al. |
| 4,046,669 | A | | 9/1977 | Blaine et al. |
| 4,108,760 | A | | 8/1978 | Williams et al. |
| 4,139,450 | A | | 2/1979 | Hanson et al. |
| 4,347,118 | A | | 8/1982 | Funk et al. |
| 4,479,541 | A | | 10/1984 | Wang |
| 4,519,463 | A | | 5/1985 | Schuh |
| 4,613,631 | A | | 9/1986 | Espenscheid et al. |
| 4,640,362 | A | | 2/1987 | Schellstede |
| 4,666,683 | A | | 5/1987 | Brown et al. |
| 4,848,486 | A | | 7/1989 | Bodine |
| 4,977,961 | A | | 12/1990 | Avasthi |
| RE33,660 | E | * | 8/1991 | Jelsma ..... E21B 7/061 175/107 |
| 5,261,489 | A | | 11/1993 | Jennings, Jr. et al. |
| 5,335,726 | A | | 8/1994 | Rodrigues |
| 5,358,051 | A | | 10/1994 | Rodrigues |
| 5,373,906 | A | | 12/1994 | Braddick |
| 5,868,210 | A | | 2/1999 | Johnson et al. |
| 5,893,416 | A | | 4/1999 | Read |
| 6,581,690 | B2 | | 6/2003 | Van Drentham-Susman et al. |
| 7,347,260 | B2 | | 3/2008 | Ferguson et al. |
| 7,422,059 | B2 | | 9/2008 | Jelsma |
| 7,431,083 | B2 | | 10/2008 | Olsen |
| 7,441,595 | B2 | | 10/2008 | Jelsma |
| 7,686,101 | B2 | | 3/2010 | Belew et al. |
| 7,788,037 | B2 | | 8/2010 | Soliman et al. |
| 7,971,658 | B2 | | 7/2011 | Buckman, Sr. |
| 7,971,659 | B2 | | 7/2011 | Gatlin et al. |
| 8,167,060 | B2 | | 5/2012 | Brunet et al. |
| 8,201,643 | B2 | | 6/2012 | Soby et al. |
| 8,220,547 | B2 | | 7/2012 | Craig et al. |
| 8,372,786 | B2 | | 2/2013 | Berkland et al. |
| 8,408,333 | B2 | | 4/2013 | Pai et al. |
| 8,420,576 | B2 | | 4/2013 | Eoff et al. |
| 8,424,620 | B2 | | 4/2013 | Perry, Jr. et al. |
| 8,590,618 | B2 | | 11/2013 | Jelsma |
| 8,672,034 | B2 | | 3/2014 | Al-Ajmi et al. |
| 8,770,316 | B2 | | 7/2014 | Jelsma |
| 9,121,272 | B2 | | 9/2015 | Potapenko et al. |
| 9,567,809 | B2 | | 2/2017 | Savage |
| 9,803,134 | B2 | | 10/2017 | De Wolf et al. |
| 10,005,955 | B2 | | 6/2018 | Beuterbaugh et al. |
| 2002/0005286 | A1 | | 1/2002 | Mazorow et al. |
| 2003/0062167 | A1 | | 4/2003 | Surjaatmadja et al. |
| 2005/0056418 | A1 | | 3/2005 | Nguyen |
| 2005/0230107 | A1 | | 10/2005 | McDaniel et al. |
| 2006/0048946 | A1 | | 3/2006 | Al-Muraikhi |
| 2006/0070740 | A1 | | 4/2006 | Surjaatmadja et al. |
| 2006/0102343 | A1 | | 5/2006 | Skinner et al. |
| 2007/0261852 | A1 | | 11/2007 | Surjaatmadja et al. |
| 2007/0261887 | A1 | | 11/2007 | Pai et al. |
| 2008/0078548 | A1 | | 4/2008 | Pauls et al. |
| 2008/0135292 | A1 | | 6/2008 | Sihler et al. |
| 2008/0139418 | A1 | | 6/2008 | Cioletti et al. |
| 2009/0017678 | A1 | | 1/2009 | Meier et al. |
| 2009/0065253 | A1 | | 3/2009 | Suarez-Rivera et al. |
| 2009/0101414 | A1 | | 4/2009 | Brunet et al. |
| 2009/0114385 | A1 | | 5/2009 | Lumbye |
| 2009/0250211 | A1 | | 10/2009 | Craig |
| 2009/0288884 | A1 | | 11/2009 | Jelsma |
| 2010/0126722 | A1 | | 5/2010 | Cornelissen et al. |
| 2010/0187012 | A1 | | 7/2010 | Belew et al. |
| 2010/0243266 | A1 | | 9/2010 | Soby et al. |
| 2010/0282470 | A1 | | 11/2010 | Alberty et al. |
| 2011/0005762 | A1 | | 1/2011 | Poole |
| 2011/0017468 | A1 | | 1/2011 | Birch et al. |
| 2011/0061869 | A1 | | 3/2011 | Abass et al. |
| 2011/0067871 | A1 | | 3/2011 | Burdette et al. |
| 2011/0068787 | A1 | | 3/2011 | Freedman et al. |
| 2011/0147088 | A1 | | 6/2011 | Brunet et al. |
| 2012/0024530 | A1 | | 2/2012 | Todd et al. |
| 2012/0067646 | A1 | | 3/2012 | Savage |
| 2012/0160567 | A1 | | 6/2012 | Belew et al. |
| 2012/0325555 | A1 | | 12/2012 | Jette et al. |
| 2013/0000908 | A1 | | 1/2013 | Walters et al. |
| 2013/0032349 | A1 | | 2/2013 | Alekseenko et al. |
| 2013/0062125 | A1 | | 3/2013 | Savage |
| 2013/0213716 | A1 | | 8/2013 | Perry et al. |
| 2013/0220606 | A1 | | 8/2013 | Yhuel et al. |
| 2013/0233537 | A1 | | 9/2013 | McEwen-King et al. |
| 2013/0304444 | A1 | | 11/2013 | Strobel et al. |
| 2013/0341029 | A1 | | 12/2013 | Roberts et al. |
| 2014/0096950 | A1 | | 4/2014 | Pyecroft et al. |
| 2014/0096966 | A1 | | 4/2014 | Freitag |
| 2014/0102708 | A1 | | 4/2014 | Purkis et al. |
| 2014/0144623 | A1 | | 5/2014 | Pyecroft et al. |
| 2014/0340082 | A1 | | 11/2014 | Yang et al. |
| 2015/0007988 | A1 | | 1/2015 | Ayasse |
| 2015/0096748 | A1 | | 4/2015 | West |
| 2015/0107825 | A1 | | 4/2015 | Miller et al. |
| 2015/0218925 | A1 | | 8/2015 | Lecampion et al. |
| 2015/0337613 | A1 | | 11/2015 | Belew et al. |
| 2015/0356403 | A1 | | 12/2015 | Storm, Jr. |
| 2016/0053597 | A1 | | 2/2016 | Brown et al. |
| 2016/0115772 | A1 | | 4/2016 | Graham et al. |
| 2016/0131787 | A1 | | 5/2016 | Quirein et al. |
| 2016/0153239 | A1 | | 6/2016 | Randall |
| 2016/0215581 | A1 | | 7/2016 | Ingraham et al. |
| 2016/0281480 | A1 | | 9/2016 | Pyecroft et al. |
| 2016/0312587 | A1 | | 10/2016 | Montaron et al. |
| 2017/0030180 | A1 | | 2/2017 | Maurer |
| 2017/0204713 | A1 | | 7/2017 | Bell et al. |
| 2018/0023375 | A1 | | 1/2018 | Potapenko et al. |
| 2018/0112468 | A1 | | 4/2018 | Savage et al. |
| 2018/0163122 | A1 | | 6/2018 | Panga et al. |
| 2018/0306017 | A1 | | 10/2018 | Savage |
| 2018/0328118 | A1 | | 11/2018 | Morse et al. |
| 2019/0017358 | A1 | | 1/2019 | Morse et al. |
| 2020/0157901 | A1 | | 5/2020 | Cardon et al. |

FOREIGN PATENT DOCUMENTS

| | | | |
|---|---|---|---|
| EP | 2631422 | A2 | 8/2013 |
| EP | 2672409 | A2 | 12/2013 |
| EP | 2198119 | B1 | 10/2017 |
| GB | 2406863 | A | 4/2005 |
| WO | 9113177 | A1 | 9/1991 |
| WO | 9420727 | A1 | 9/1994 |
| WO | 0046484 | A1 | 8/2000 |
| WO | 03050377 | A2 | 6/2003 |
| WO | 2004046494 | A2 | 6/2004 |
| WO | 2005090747 | A1 | 9/2005 |
| WO | 2009096805 | A1 | 8/2009 |
| WO | 2009157812 | A1 | 12/2009 |
| WO | 2013019390 | A1 | 2/2013 |
| WO | 2015089458 | A1 | 6/2015 |
| WO | 2016138005 | A1 | 9/2016 |
| WO | 2017074722 | A1 | 5/2017 |
| WO | 2017078989 | A1 | 5/2017 |
| WO | 2018049311 | A1 | 3/2018 |
| WO | 2018049367 | A1 | 3/2018 |
| WO | 2018049368 | A1 | 3/2018 |
| WO | 2018129136 | A1 | 7/2018 |
| WO | 2019014160 | A1 | 1/2019 |
| WO | 2019014161 | A1 | 1/2019 |
| WO | 2019168885 | A1 | 9/2019 |

(56) References Cited

FOREIGN PATENT DOCUMENTS

| | | | |
|---|---|---|---|
| WO | 2019241454 | A1 | 12/2019 |
| WO | 2019241455 | A1 | 12/2019 |
| WO | 2019241456 | A1 | 12/2019 |
| WO | 2019241457 | A1 | 12/2019 |
| WO | 2019241458 | A1 | 12/2019 |

OTHER PUBLICATIONS

Alekseenko O.P. , Potapenko D.I., Kuranakov D.S., Lapin V.N., Cherny S.G., and Esipov D.V. "3D Modeling of Fracture Initiation from Cemented Perforated Wellbore", presented at 19th European Conference on Fracture, Kazan, Russia, Aug. 26-31, 2012.

Potyondy, "Simulating stress corrosion with a bonded-particlle model for rock", International Journal of Rock Mechanics and Mining Sciences, vol. 44, Issue 5, Jul. 2007, pp. 677-691. https://www.sciencedirect.com/science/article/pii/S1365160906001560.

Atkinson et al., "Acoustic Emission During Stress Corrosion Cracking in Rocks", Earthquake Predition: An International Review, vol. 4, pp. 605-616, 1981. https://agupubs.onlinelibrary.wiley.com/doi/pdf/10.1029/ME004p0605.

Wikipedia.org, "Wood's metal", edited May 4, 2019, Accessed Jul. 3, 2019; https://en.wikipedia.org/wiki/Wood%27s_metal.

Pinto, I.S.S et al., "Biodegradable chelating agents for industrial, domestic, and agricultural applications—a review", Environmental Science and Pollution Research, 2014, 21, p. 11893-11906.

Office Action received in U.S. Appl. No. 16/629,992 dated Apr. 21, 2021, 53 pages.

* cited by examiner

SLIDER COMPENSATED FLEXIBLE SHAFT DRILLING SYSTEM

CROSS-REFERENCE TO RELATED APPLICATION

This application claims priority to and the benefit of U.S. Provisional Application No. 62/730,679, entitled "Slider Compensated Flex Shaft Drilling System," filed Sep. 13, 2018, which is hereby incorporated by reference in its entirety for all purposes.

BACKGROUND

The present disclosure generally relates to downhole radial drilling systems and, more particularly, to systems and methods for compensating for axial compression and extension of a flexible drive shaft of a downhole radial drilling system.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as an admission of any kind.

Radial drilling is generally used to drill relatively small-diameter horizontal wellbores. With this drilling technique, new wellbores may be drilled relatively perpendicular from a main wellbore and into a reservoir formation. In a cased wellbore, a special cutting bottom hole assembly (BHA) may be used to drill a hole in casing. This cutting BHA may be run through a workstring equipped with a deflector shoe, which has an internal channel that is oriented somewhat laterally into the casing when lowered downhole. The cutting BHA may consist of a downhole positive displacement motor (PDM), a flexible drive shaft, and a cutting bit. The flexible drive shaft is designed to bend inside a relatively short-radius curvature internal channel in the deflector shoe, and to transmit the force and torque from the PDM to the cutting bit. Due to the nature of its design, the flexible drive shaft will bend by its own weight when placed at an angle that is different from a straight down vertical position. This flexibility may make it relatively difficult to convey the flexible drive shaft, and to stab the flexible drive shaft into the deflector shoe in deviated wellbores. In addition, excessive compressive load applied to the flexible drive shaft when the flexible drive shaft is bent or buckled while being run into the hole or when the flexible drive shaft is hung up on an obstruction may inadvertently damage the flexible drive shaft.

Conventional methods that allow drilling with a curved system only through a single casing string, thereby limiting the application to single casing completion, may be limited in application due to the non-compensating nature of the flexible drive shaft, which may restrict the useful length of the flexible drive shaft that is available, as well as restrict the ability to maintain fluid flow thru the flexible drive shaft for cooling and cleaning, and may not allow for through-flow of cooling fluids and cleaning fluids, which may lead to relatively fast deterioration of the conventional systems once penetrated through the casing. Existing methods and/or systems may also be limited to casing penetrating only, and require additional operational activities to penetrate the formation, which is relatively time consuming and costly.

Existing methods and/or systems may also have limited flexibility in the curve drilling, and uncontrollable drilling once out of the casing due to the nature of the knuckles and lobes cut in the flexible drive shaft. Existing methods and/or systems may also have limits on torque transfer inherent to the flexible drive shaft.

SUMMARY

A summary of certain embodiments described herein is set forth below. It should be understood that these aspects are presented merely to provide the reader with a brief summary of these certain embodiments and that these aspects are not intended to limit the scope of this disclosure.

Certain embodiments of the present disclosure include a drilling system that includes a deflecting device having an internal passage extending therethrough, and a flexible drilling assembly configured to extend through the internal passage of the deflecting device, and to create a perforation lateral tunnel in a wellbore. The flexible drilling assembly includes a flexible drive shaft configured to rotate relative to the internal passage of the deflecting device. The flexible drilling assembly also includes a cutting bit disposed at a first axial end of the flexible drilling assembly. The flexible drilling assembly further includes a slider tube disposed at a second axial end of the flexible drilling assembly. In addition, the flexible drilling assembly includes a slider radially disposed within the slider tube. The slider is configured to compensate for expansion and compression of the flexible drive shaft while the perforation lateral tunnel is being created in the wellbore by the flexible drilling assembly.

In addition, certain embodiments of the present disclosure include a flexible drilling assembly includes a flexible drive shaft, a cutting bit disposed at a first axial end of the flexible drilling assembly, a slider tube disposed at a second axial end of the flexible drilling assembly, and a slider radially disposed within the slider tube. The slider is configured to slide axially within the slider tube to compensate for expansion and compression of the flexible drive shaft during operation of the flexible drilling assembly.

In addition, certain embodiments of the present disclosure include a drilling system that includes a deflecting device comprising an internal passage extending therethrough, and a flexible drilling assembly configured to extend through the internal passage of the deflecting device, and to create a perforation lateral tunnel in a wellbore. The flexible drilling assembly includes a motor sealing connection disposed at a first axial end of the flexible drilling assembly. The motor sealing connection is configured to be driven by a power source. The flexible drilling assembly also includes a slider tube coupled to the motor sealing connection. The flexible drilling assembly further includes a flexible drive shaft configured to rotate relative to the internal passage of the deflecting device. In addition, the flexible drilling assembly includes a fluid transfer hose disposed radially within the slider tube and the flexible drive shaft. The fluid transfer hose is configured to provide a fluid to the cutting bit. The flexible drilling assembly also includes a cutting bit disposed at a second axial end of the flexible drilling assembly. The cutting bit includes a plurality of flow channels disposed therethrough to receive the fluid from the fluid transfer hose. The flexible drilling assembly further includes a bit box that connects the flexible drive shaft to the cutting bit. The bit box includes a plurality of flow channels disposed therethrough to convey the fluid to the cutting bit from the fluid transfer hose. In addition, the flexible drilling assembly includes a slider radially disposed within the slider tube. The slider is coupled to the fluid transfer hose. The slider is configured to slide axially within the slider tube to compensate for expansion and compression of the flexible drive shaft while the perforation lateral tunnel is being created in the wellbore by the flexible drilling assembly. The slider includes one or more hydraulic flow channels extending axially along an exterior surface of the slider to provide pressure compensation.

Various refinements of the features noted above may be undertaken in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings, in which.

DETAILED DESCRIPTION

Figure 1:
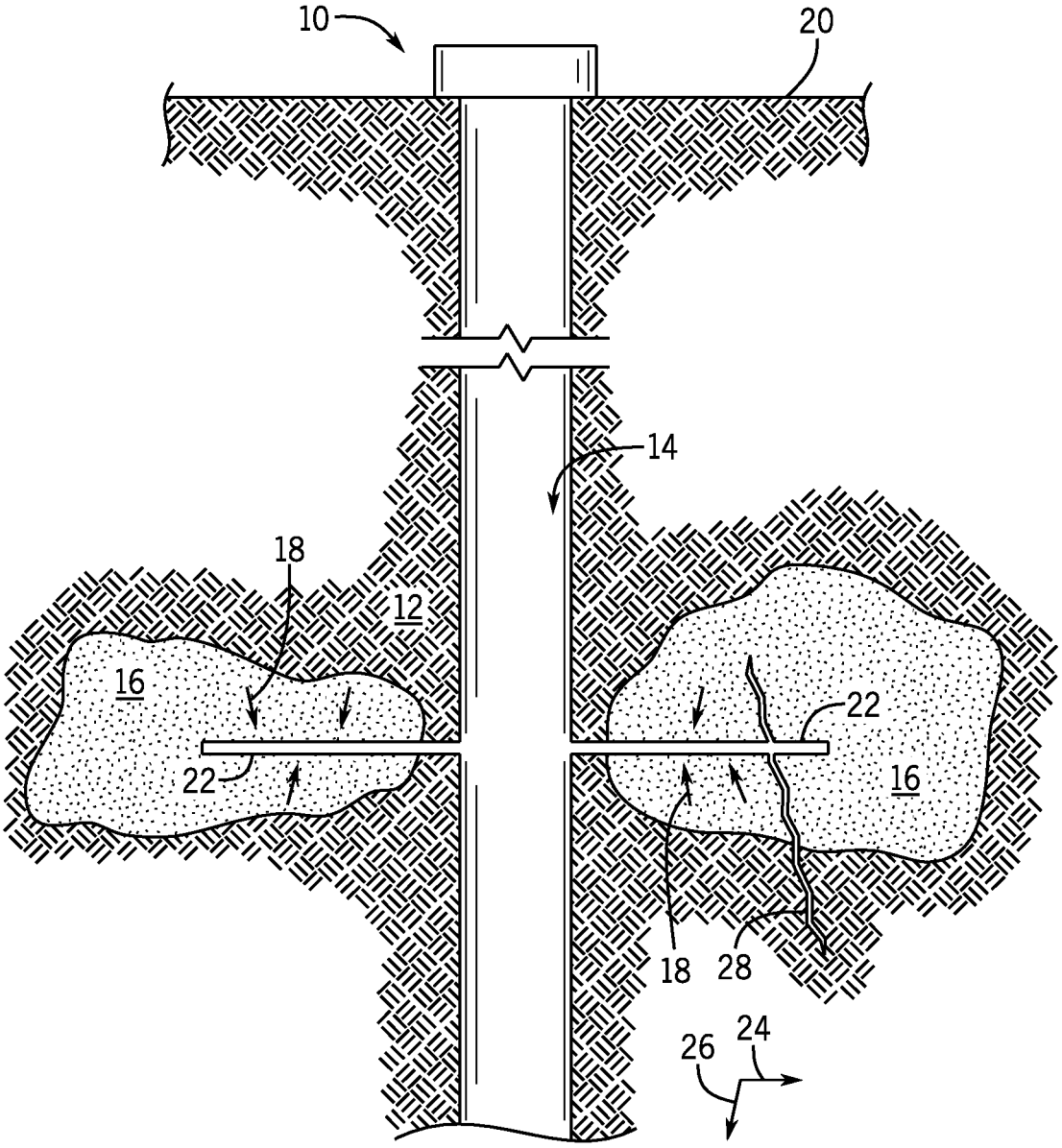
FIG. 1 is a schematic illustration of a well system extending into a subterranean formation, in accordance with embodiments of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As used herein, the terms "connect," "connection," "connected," "in connection with," and "connecting" are used to mean "in direct connection with" or "in connection with via one or more elements"; and the term "set" is used to mean "one element" or "more than one element." Further, the terms "couple," "coupling," "coupled," "coupled together," and "coupled with" are used to mean "directly coupled together" or "coupled together via one or more elements." As used herein, the terms "up" and "down," "uphole" and "downhole", "upper" and "lower," "top" and "bottom," and other like terms indicating relative positions to a given point or element are utilized to more clearly describe some elements. Commonly, these terms relate to a reference point as the surface from which drilling operations are initiated as being the top (e.g., uphole or upper) point and the total depth along the drilling axis being the lowest (e.g., downhole or lower) point, whether the well (e.g., wellbore, borehole) is vertical, horizontal or slanted relative to the surface.

The embodiments of the present disclosure provide a downhole radial drilling system with the ability (vertically, horizontally and at any radius of curvature) of the drilling or cutting bit to cut through at least one steel casing and subsequently into the reservoir rocks to penetrate the reservoir, at any length, with a single cutting run controlled by coil systems or drilling systems. In addition, the embodiments of the present disclosure provide a downhole radial drilling system that allows exiting of the drilling or cutting bit from a deflecting device at any angle from a main wellbore (lined or unlined) into the hydrocarbon reservoir at any selected distance and direction from the main wellbore. In addition, the embodiments of the present disclosure provide a downhole radial drilling system useful in various applications including vertical wellbores, horizontal wellbores, and any angle therebetween for existing wellbores, as well as in newly drilled wellbores.

In addition, the embodiments of the present disclosure provide a downhole radial drilling system with the ability to enter into existing wellbores that have single or multiple liners, and with the ability to penetrate these liner(s) and continue penetrating into the formation, thereby extending out into the formation with man-made permeability channels (i.e., perforation lateral tunnels) to improve production. At the same time, these penetrations increase the formation exposure to man-made flow channels, which allow for less resistance to flow of the formation fluids into the main wellbore and, hence, increase production. In addition, the relatively deep penetration of the man-made permeability channels into the producing reservoir allows (in older and in newly drilled wells) for the permeability channel to penetrate beyond the near-wellbore damage that occurs when drilling the new wellbore or that occurs after a certain time of producing as a result of fines blocking or mineralization. The downhole radial drilling system of the present disclosure is designed to go beyond that near-wellbore damage when forming the permeability channels. In addition, the downhole radial drilling system of the present disclosure is designed to reach bypassed zones in a producing wellbore, and to allow for an effective method to reach thin bedding producing layers in the wellbore, which are relatively difficult to reach using conventional systems and methods.

Turning now to the drawings, FIG. 1 is a schematic illustration of a well system 10 extending into a subterranean formation 12. The well system 10 enables a methodology for enhancing recovery of hydrocarbon fluid (e.g., oil and/or gas) from a well. In certain embodiments, a borehole 14 (e.g., a generally vertical wellbore) is drilled down into the subterranean formation 12. In certain embodiments, the borehole 14 may be drilled into or may be drilled outside of a target zone 16 (or target zones 16) containing, for example, a hydrocarbon fluid 18.

In the illustrated embodiment, the borehole 14 is a generally vertical wellbore extending downwardly from a surface 20. However, certain operations may create deviations in the borehole 14 (e.g., a lateral section of the borehole 14) to facilitate hydrocarbon recovery. In certain embodiments, the borehole 14 may be created in non-productive rock of the formation 12 and/or in a zone with petrophysical and/or geomechanical properties different from the properties found in the target zone or zones 16.

At least one perforation lateral tunnel 22 (e.g., a plurality of perforation lateral tunnels 22, in certain embodiments) may be created to intersect the borehole 14. In the illustrated embodiment, at least two perforation lateral tunnels 22 are created to intersect the borehole 14 and to extend outwardly from the borehole 14. For example, in certain embodiments, the perforation lateral tunnels 22 may be created and oriented laterally (e.g., generally horizontally) with respect to the borehole 14. Additionally, in certain embodiments, the perforation lateral tunnels 22 may be oriented to extend from the borehole 14 in different directions (e.g., opposite directions) so as to extend into the desired target zone or zones 16.

In general, the perforation lateral tunnels 22 provide fluid communication with an interior of the borehole/wellbore 14 to facilitate flow of the desired hydrocarbon fluid 18 from the perforation lateral tunnels 22, into borehole 14, and up through borehole 14 to, for example, a collection location at surface 20. Furthermore, in certain embodiments, the perforation lateral tunnels 22 may be oriented in selected directions based on the material forming the subterranean formation 12 and/or on the location of desired target zones 16.

Depending on the characteristics of the subterranean formation 12 and the target zones 16, the perforation lateral tunnels 22 may be created along various azimuths. For example, in certain embodiments, the perforation lateral tunnels 22 may be created in alignment with a direction of maximum horizontal stress, represented by arrow 24, in the formation 12. However, in other embodiments, the perforation lateral tunnels 22 may be created along other azimuths, such as in alignment with a direction of minimum horizontal stress in the formation 12, as represented by arrow 26.

In certain embodiments, the perforation lateral tunnels 22 may be created at a desired angle or angles with respect to principal stresses when selecting azimuthal directions. For example, in certain embodiments, the perforation lateral tunnel (or perforation lateral tunnels) 22 may be oriented at a desired angle with respect to the maximum horizontal stress in formation 12. It should be noted that, in certain embodiments, the azimuth and/or deviation of an individual perforation lateral tunnel 22 may be constant. However, in other embodiments, the azimuth and/or deviation may vary along the individual perforation lateral tunnel 22 to, for example, enable creation of the perforation lateral tunnel 22 through a desired zone 16 to facilitate recovery of the hydrocarbon fluids 18.

Additionally, in certain embodiments, at least one of the perforation lateral tunnels 22 may be created and oriented to take advantage of a natural fracture 28 or multiple natural fractures 28, which occur in the formation 12. The natural fracture 28 may be used as a flow conduit that facilitates flow of the hydrocarbon fluid 18 into the perforation lateral tunnel (or perforation lateral tunnels) 22. Once the hydrocarbon fluid 18 enters the perforation lateral tunnels 22, the hydrocarbon fluid 18 is able to readily flow into the wellbore 14 for production to the surface 20 and/or other collection location.

Depending on the parameters of a given formation 12 and hydrocarbon recovery operation, the diameter and length of the perforation lateral tunnels 22 also may vary. In certain embodiments, the perforation lateral tunnels 22 extend from the borehole 14 at least 10 feet (3.05 meters) into the formation 12 surrounding the borehole 14. However, other embodiments may utilize perforation lateral tunnels 22 that extend from the borehole 14 at least 15 feet (4.6 meters) into the formation 12. Yet other embodiments may utilize perforation lateral tunnels 22 that extend from the borehole 14 at least 20 feet (6.1 meters) into the formation 12. Indeed, certain embodiments may utilize perforation lateral tunnels 22 substantially longer than 20 feet (6.1 meters). For example, in certain embodiments, some of the perforation lateral tunnels 22 may extend from the borehole 14 at least 100 feet (30.5 meters), at least 200 feet (61 meters), between 300 feet (91 meters) and 1,600 feet (488 meters), or even more, into the formation 12.

In certain embodiments, each perforation lateral tunnel 22 also has a diameter generally smaller than the diameter of borehole 14 (e.g., smaller than the diameter of a casing used to line borehole 14). With respect to diameter, in certain embodiments, the perforation lateral tunnel diameter may range, for example, from 0.5 inches (12.7 millimeters) to 5.0 inches (12.7 centimeters). However, in other embodiments, the perforation lateral tunnel diameter may be within a range of 0.5 inches (12.7 millimeters) to 10 inches (25.4 centimeters), within a range of 1 inch (25.4 millimeters) and 5 inches (12.7 centimeters), within a range of 1.5 inches (3.8 centimeters) and 3 inches (7.6 centimeters), and so forth. However, in other embodiments, the perforation lateral tunnels 22 may utilize a diameter of 2 inches (5.1 centimeters) or less. However, other embodiments may utilize perforation lateral tunnels 22 having a diameter of 1.5 inches (3.8 centimeters) or less. The actual lengths, diameters, and orientations of the perforation lateral tunnels 22 may be adjusted according to the parameters of the formation 12, the target zones 16, and/or objectives of the hydrocarbon recovery operation.

Figure 2:
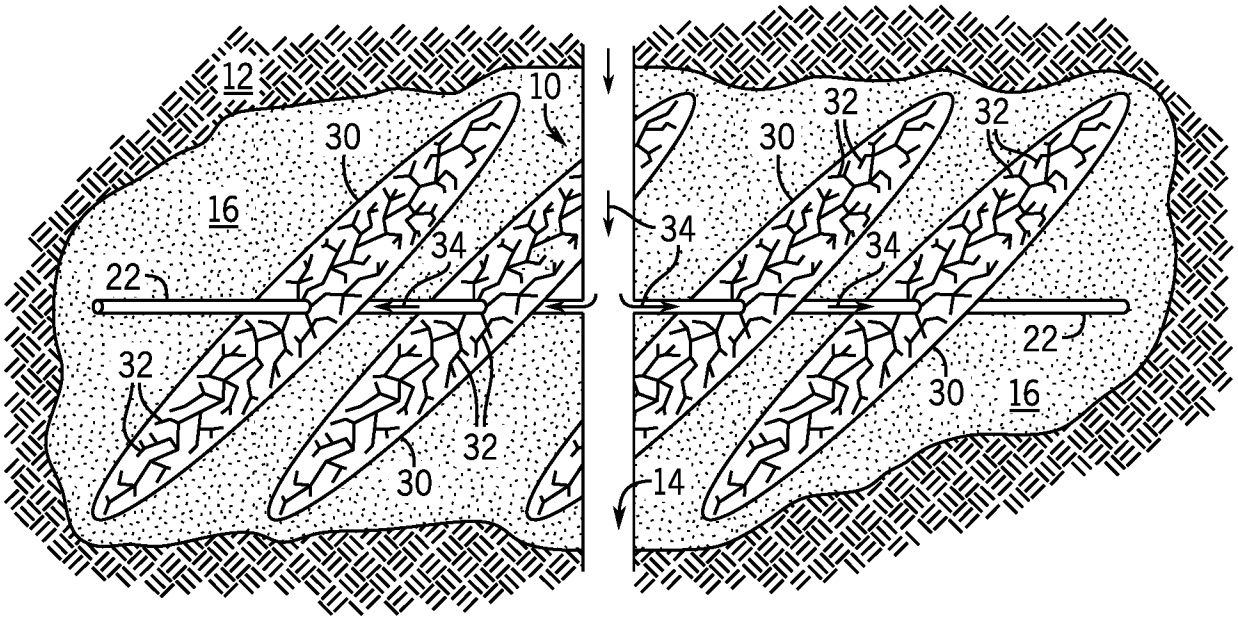
FIG. 2 is a schematic illustration of a well system having a plurality of perforation lateral tunnels extending from a borehole to deliver stimulating fluid, in accordance with embodiments of the present disclosure.

FIG. 2 is a schematic illustration of a well system 10 having a plurality of perforation lateral tunnels 22 extending from a borehole 14 to deliver stimulating fluid to stimulation zones 30 that are distributed through the target zone(s) 16. Distributing the stimulating fluid under pressure to the stimulation zones 30 creates fracture networks 32. The fracture networks 32 facilitate flow of fluid into the corresponding perforation lateral tunnels 22. By way of example, the stimulation operation may include hydraulic fracturing performed to fracture the subterranean formation 12 (e.g., oil- or gas-bearing target zone 16) so as to facilitate flow of the desired fluid along the resulting fracture networks 32 and into the corresponding perforation lateral tunnels 22.

If the stimulation operation is a hydraulic fracturing operation, fracturing fluid may be pumped from the surface 20 under pressure, down through wellbore 14, into the perforation lateral tunnels 22, and then into the stimulation zones 30 surrounding the corresponding perforation lateral tunnels 22, as indicated by arrows 34. The pressurized fracturing fluid 34 causes the formation 12 to fracture in a manner that creates the fracture networks 32 in the stimulation zones 30. In certain embodiments, the perforation lateral tunnels 22/stimulation zones 30 may be fractured sequentially. For example, the fracturing operation may be performed through sequential perforation lateral tunnels 22 and/or sequentially through individual perforation lateral tunnels 22 to cause sequential fracturing of the stimulation zones 30 and creation of the resultant fracture networks 32.

Figure 4:
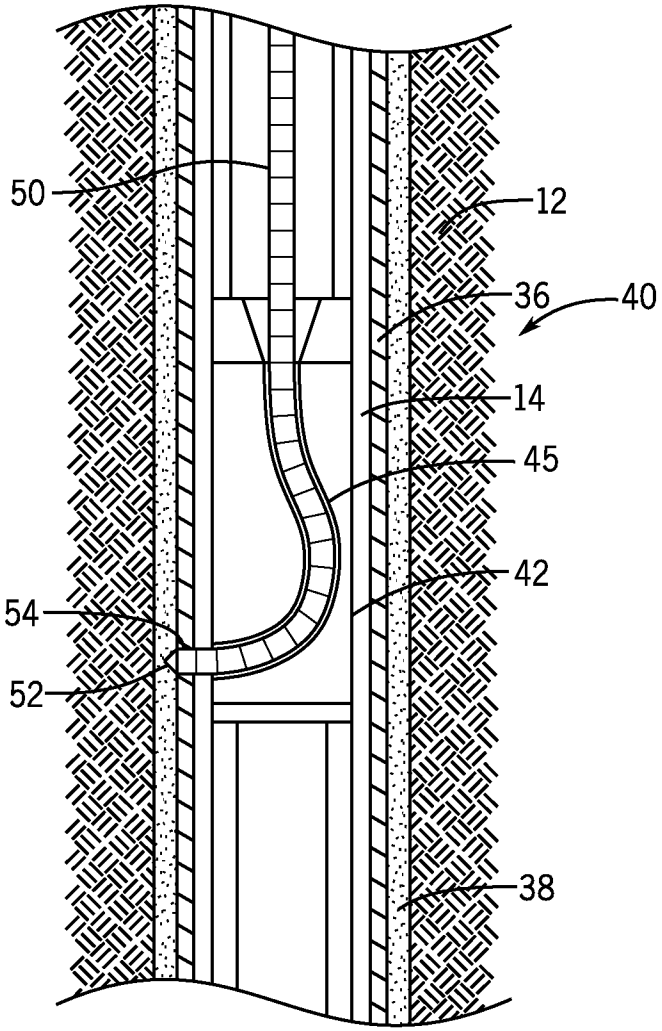
FIG. 4 is a schematic view of the downhole radial drilling system illustrated in FIG. 3 in a different stage of operation, in accordance with embodiments of the present disclosure.
Figure 3:
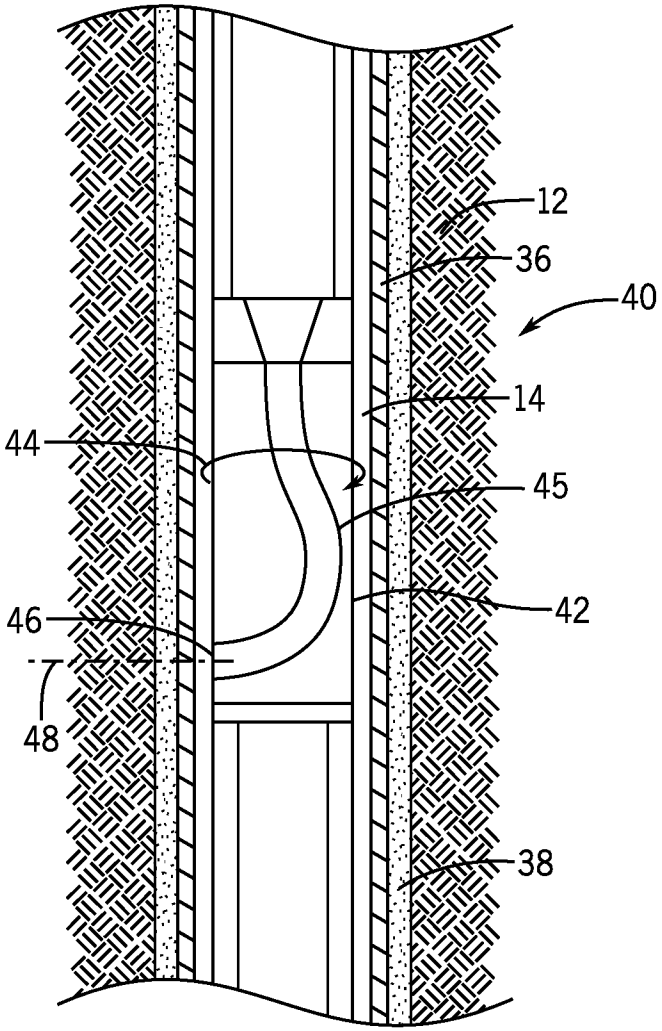
FIG. 3 is a schematic sectional view of at least a portion of a downhole radial drilling system, in accordance with embodiments of the present disclosure.

As described in greater detail herein, the perforation lateral tunnels 22 may be created via a variety of techniques. For example, in certain embodiments, drilling equipment may be deployed down into wellbore 14 and used to create the desired number of perforation lateral tunnels 22 in appropriate orientations for a given subterranean environment and production operation. FIGS. 3 and 4 are schematic sectional views of a portion of an example downhole radial drilling system 40 (e.g., cutting BHA) positioned within a wellbore 14 and operable to from perforation lateral tunnels 22 extending from the wellbore 14. For example, FIG. 3 illustrates a portion of a wellbore 14 including a casing 36 (which may be secured by cement 38 or installed open-hole) extending through a subterranean formation 12. In certain embodiments, the downhole radial drilling system 40 includes a deflecting device 42 (e.g., deflector shoe) operable to deflect or otherwise direct a drilling, cutting, or other boring device toward a sidewall of the wellbore 14 to create a perforation lateral tunnel 22. In certain embodiments, the deflecting device 42 may be rotatably oriented with respect to the wellbore 14, as indicated by arrow 44, to rotatably align or orient an outlet port 46 of an internal passage 45 of the deflecting device 42 in an intended direction (e.g., a substantially vertical direction). In certain embodiments, an axis 48 of the outlet port 46 is oriented substantially orthogonal (e.g., within 5 degrees, within 2 degrees, within 1 degree, or even closer, to exactly orthogonal) to the casing 36 through which the perforation lateral tunnel 22 extends.

As illustrated in FIG. 4, in certain embodiments, after the deflecting device 42 is positioned at an intended longitudinal (e.g., axial) location within the wellbore 14 and at an intended rotational orientation, a flexible drilling assembly 50 terminating with a drilling, milling, cutting, or other bit 52 may be deployed through the internal passage 45 of the downhole radial drilling system 40 to create a perforation 54 (i.e., a hole) through the casing 36. After the perforation lateral tunnel 22 is created, the deflecting device 42 may be reoriented to create another perforation lateral tunnel 22 or moved longitudinally along the wellbore 14 to a selected location (e.g., at another formation zone 16). The process may be repeated until the intended number of perforation lateral tunnels 22 are created along the entire wellbore 14 or into several formation zones 16.

Figure 5:
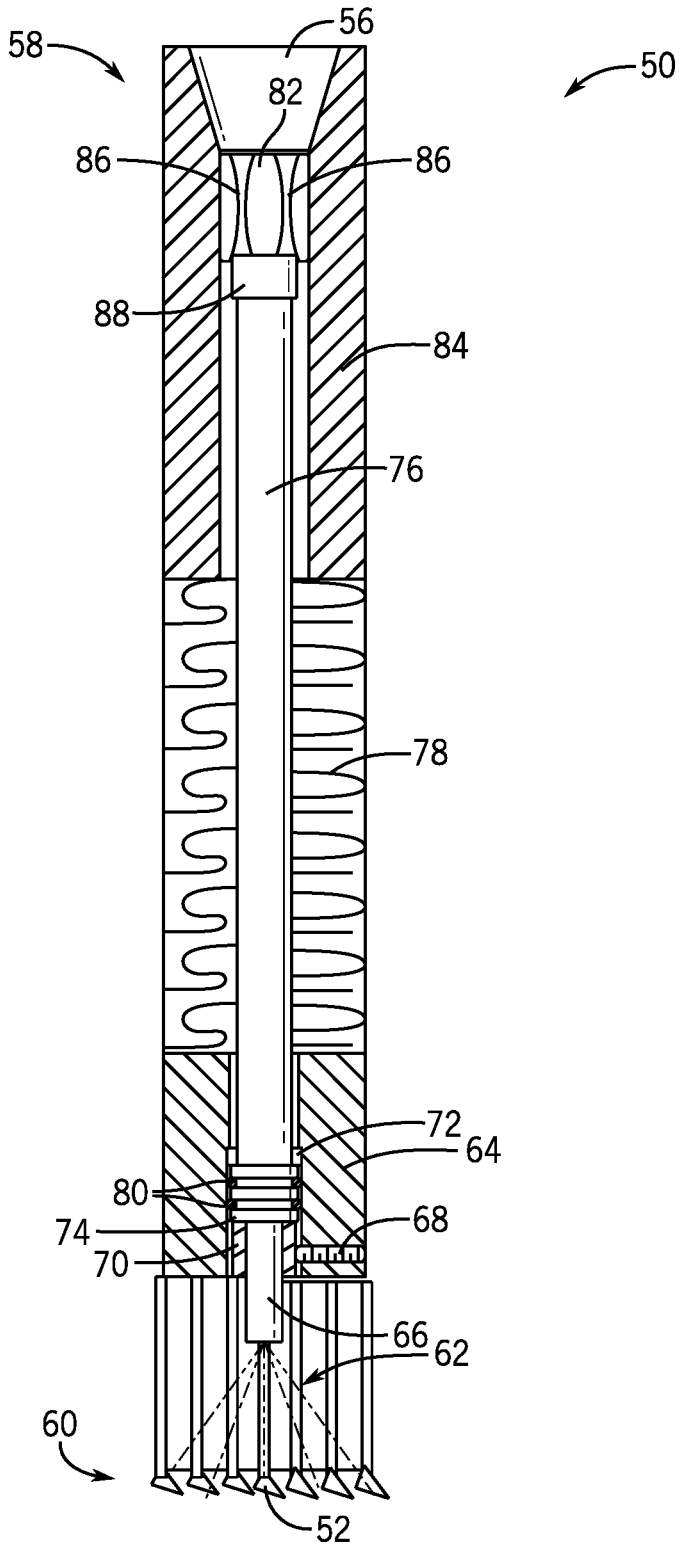
FIG. 5 is a cross-sectional view of a flexible drilling assembly of the downhole radial drilling system, in accordance with embodiments of the present disclosure.

FIG. 5 is a cross-sectional view of an embodiment of the flexible drilling assembly 50. As illustrated, in certain embodiments, the flexible drilling assembly 50 includes a motor sealing connection 56 at a first (e.g., uphole) axial end 58 of the flexible drilling assembly 50 and a cutting bit 52 at a second, opposite (e.g., downhole) axial end 60 of the flexible drilling assembly 50. In general, the cutting bit 52 has a cutting structure that provides the ability to cut through steel casing or casings (e.g., the casing 36 described herein) as well as rock of the subterranean formation 12. In certain embodiments, the cutting bit 52 includes flow channels 62 therethrough for providing cleaning and cooling fluid through the cutting bit 52. As illustrated, in certain embodiments, a bit box 64 may be disposed above and connected to the cutting bit 52. As illustrated, in certain embodiments, the bit box 64 includes flow channels 66 in fluid communication with the flow channels 62 of the cutting bit 52. In addition, in certain embodiments, the bit box 64 may include bit setting screws 68 for attaching the cutting bit 52 to the bit box 64.

Figure 7:
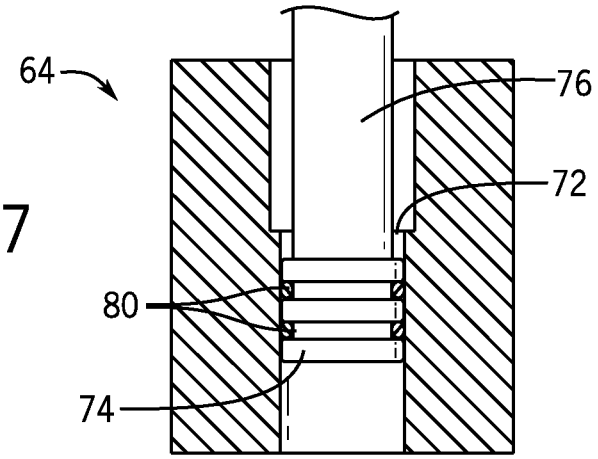
FIG. 7 is a cross-sectional view of a portion of a bit box of the flexible drilling assembly of FIG. 5, in accordance with embodiments of the present disclosure.

As illustrated in FIGS. 5 and 7, in certain embodiments, a central limiter channel 70 may be disposed through the bit box 64, within which a limiter 72 and a sealing piston 74 are disposed for isolation and fluid containment (e.g., of the cleaning and cooling fluid delivered to the cutting bit 52 via the bit box 64) of a downhole axial end of a fluid transfer hose 76 that extends through the bit box 64, as well as through the cutting bit 52 and a flexible drive shaft 78 of the flexible drilling assembly 50. In addition, in certain embodiments, the sealing piston 74 may also be associated with one or more sealing O-rings 80 that further enables the isolation and fluid containment. In general, the fluid transfer hose 76 facilitates the flow of relatively high pressure cleaning and cooling fluids of various chemical compositions to be delivered therethrough to the cutting bit 52.

Figure 6:
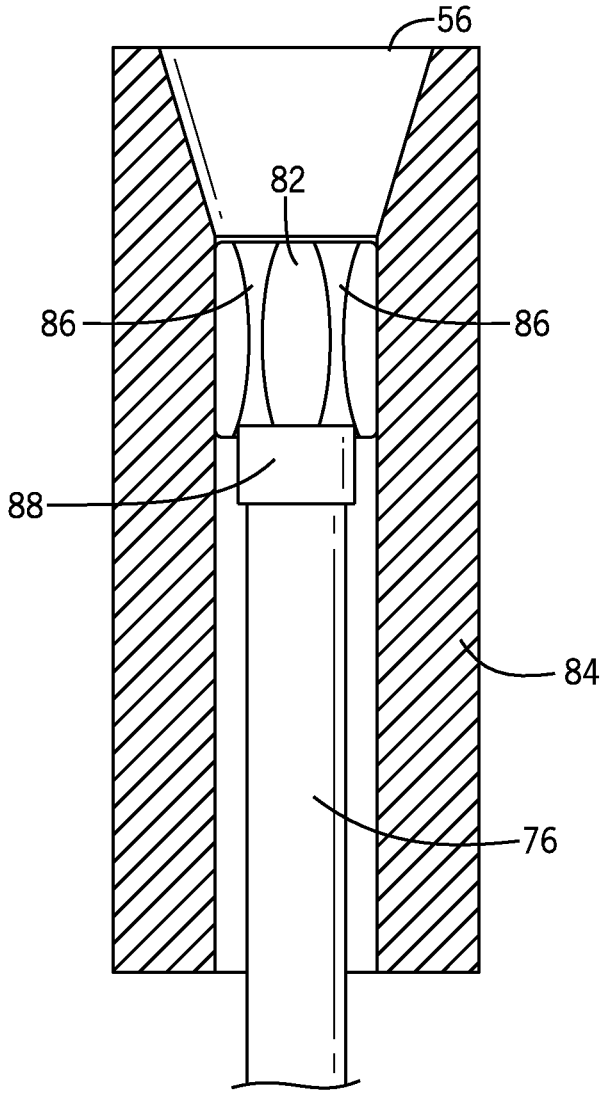
FIG. 6 is a cross-sectional view of a portion of a slider tube of the flexible drilling assembly of FIG. 5, in accordance with embodiments of the present disclosure.

As illustrated in FIGS. 5 and 6, in certain embodiments, a slider 82 is disposed within a slider tube 84 that physically couples the motor sealing connection 56 and the flexible drive shaft 78 together. In certain embodiments, the flexible drive shaft 78 physically couples the bit box 64 to the slider 82 disposed within the slider tube 84. The specific flex cut of the components of the flexible drive shaft 78 allows for full rotational motion of the flexible drive shaft 78 in any radius of curvature, and operates in full extension and full compression to allow rotational power transfer along the flexible drive shaft 78. In general, the slider 82 is configured to compensate for the compression and extension of the flexible drive shaft 78 and the fluid transfer hose 76, which transfers part of the volume and pressure of the cleaning and cooling fluids from the motor sealing connection 56 to the cutting bit 52.

Figure 12A:
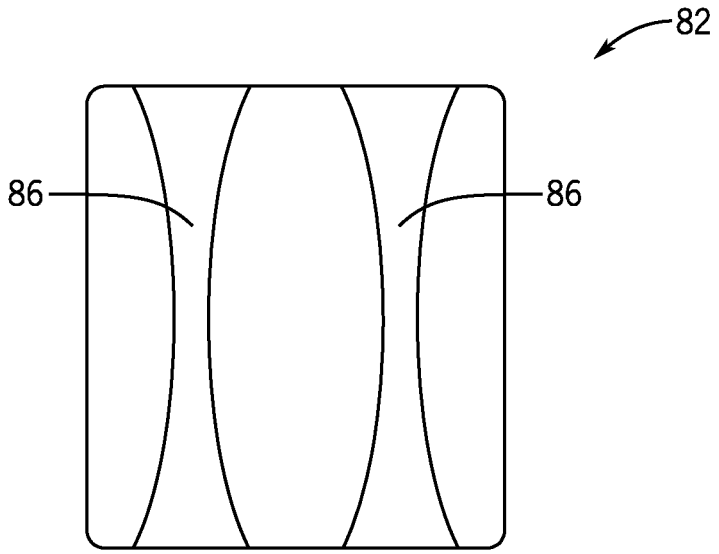
FIGS. 12A and 12B are a side view and a cross-sectional view, respectively, of a slider as described herein, in accordance with embodiments of the present disclosure.
Figure 12B:
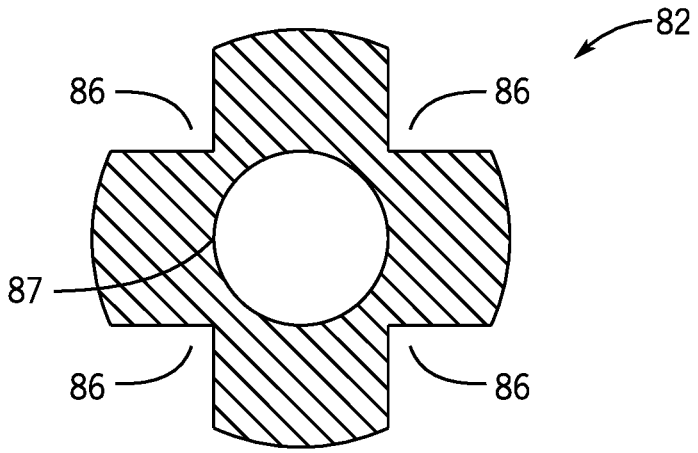

In certain embodiments, the slider 82 may have one or more hydraulic flow channels 86 extending axially along an outer circumference of the slider 82. In certain embodiments, the cross-sectional flow area of the one or more hydraulic flow channels 86 may be equal to or less than the cross-sectional central flow area 87 through the slider 82, which is illustrated in FIG. 12B, to compensate with the pressure hold down factor during operation. In general, the one or more hydraulic flow channels 86 enable the slider 82 to slide or translate within and along the entire axial length of the slider tube 84 during operation of the downhole radial drilling system 40, thereby compensating for the compression and extension of the flexible drive shaft 78 that occurs during the operation of the downhole radial drilling system 40. In certain embodiments, the fluid transfer hose 76 is coupled to the slider 82 by a sealing high-pressure clamping device 88 that provides full sealing for the flow of cleaning and cooling fluids through the flexible drilling assembly 50 from the motor sealing connection 56 to the cutting bit 52. It will be appreciated that the motor sealing connection 56 allows for the use of specifically designed power sources or for commercially available high-speed rotating power systems (not shown), such as those driven hydraulically, electrically, pneumatically, or by any fluid media.

As described in greater detail herein, the downhole radial drilling system 40 is configured to be positioned with the wellbore 14, at which point the flexible drilling assembly 50 may be deflected by the internal passage 45 through the deflecting device 42 of the downhole radial drilling system 40 such that the cutting bit 52 of the flexible drilling assembly 50 may penetrate the casing 36, and subsequently penetrate the rock of the subterranean formation 12. As such, the downhole radial drilling system 40 allows for single-run operations that are fully capable of penetrating steel and rock, which are designed to maintain cooling and cleaning with the use of well-designed flow erosion forces and rotating erosional forces. For example, the downhole radial drilling system 40 is configured to clean out debris generated by the cutting bit 52, and may be positioned to use any type of fluids, gases, and/or other chemical or hydraulic media to achieve penetration, cleaning, and borehole stability using commercially available chemical controlling agents.

Figure 8:
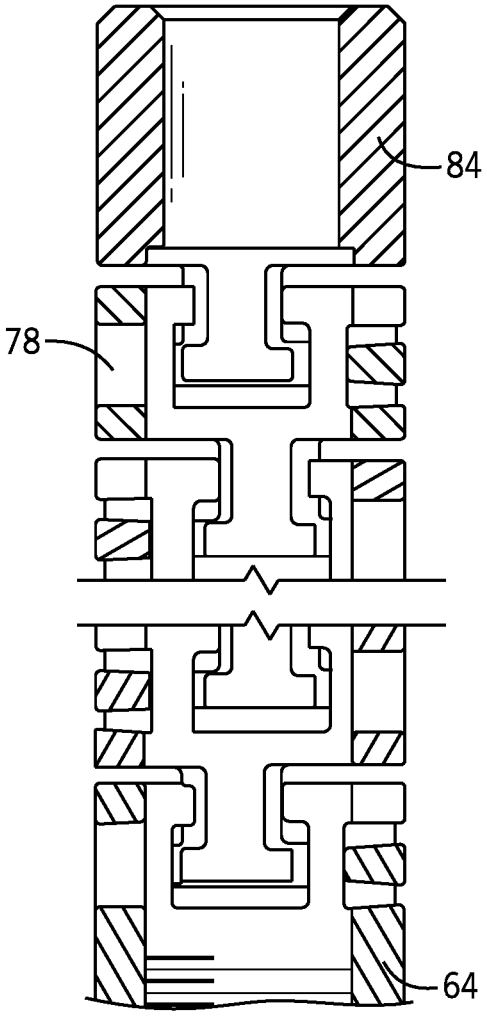
FIG. 8 is a cross-sectional view of a flexible drive shaft and the bit box of the flexible drilling assembly, in accordance with embodiments of the present disclosure.
Figure 9:
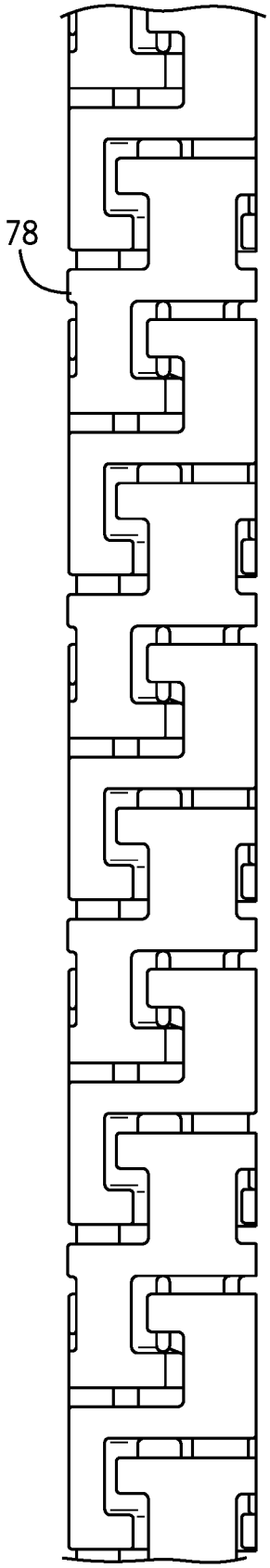
FIG. 9 is a cross-sectional view of the flexible drive shaft of the flexible drilling assembly, in accordance with embodiments of the present disclosure.

In addition, as described in greater detail herein, operation of the flexible drilling assembly 50 of the downhole radial drilling system 40 may be powered by a commercially available power source (not shown) connected to the motor sealing connection 56, below which is the slider tube 84, connected to the flexible drive shaft 78, as illustrated in FIG. 8. The flexible drive shaft 78 may then be connected to the bit box 64, which holds the cutting bit 52, for example, via a setting screw 68, as illustrated in FIG. 5.

As illustrated in FIGS. 5 and 6, the slider 82 is disposed radially inside the slider tube 84, pressure balanced by one or more hydraulic flow channels 86 extending axially along an exterior surface of the slider 82 for fluid balancing, in certain embodiments. In other words, the hydraulic flow channels 86 help balance out the pressure with the center flow area 87 through the slider 82. The slider 82 is configured such that it is free to move inside the slider tube 84 directly in line axially with the total extension and compression of the flexible drive shaft 78. This compensation and movement by the slider 82 prevents breakage of the fluid transfer hose 76 when operating in either a compressed or expanded position. When the flexible drive shaft 78 is expanded or lengthened, the drilling/cutting/penetrating of the cutting bit 52 takes place through the casing 36 and the formation 12. During operation, when the flexible drive shaft 78 is drilling, the flexible drive shaft 78 will slowly be lengthened as the weight on the cutting bit 52 is removed. In other words, the formation 12 is drilled in front of the cutting bit 52, the weight of which keeps the flexible drive shaft 78 in compression. In certain embodiments, the length of the slider tube 84 is directly proportional to the overall length of the flexible drive shaft 78, which then compensates for the expansion and contraction of the flexible drive shaft 78 as it is being used for rotating the cutting bit 52.

Since the cutting bit 52 is configured to cut through steel and rock, the cutting bit 52 may need cooling and cleaning fairly regularly. To that end, the fluid transfer hose 76 extending through the center of the flexible drilling assembly 50 acts as a conduit of the required fluid at relatively high pressure to clean and cool the cutting bit 52.

As illustrated in FIG. 5, in certain embodiments, the cutting bit 52 is connected to the flexible drive shaft 78 through the bit box 64 in which there is a setting screw 68 for the shaft (not shown) of the cutting bit 52 to lock in, a section in which the lower piston 74 with sealing O-rings 80 is located. In certain embodiments, the lower piston 74 does not move, and seals the lower end of the fluid transfer hose 76 so that a hermetically sealed flexible drilling assembly 50 is provided. In certain embodiments, the limiter channel 70 has a limiter 72 that prevents the lower piston 74 from axially moving into the flexible drive shaft 78, and also forms a lower restraint for preventing axial movement of the fluid transfer hose 76 inside the flexible drive shaft 78 and the slider tube 84.

As the downhole radial drilling system 40 is deployed into a wellbore at the end of a conveyance, such as coil tubing, wireline or jointed tubing, the flexible drive shaft 78 is extended to the maximum by gravity and by design of the multiple lobe type cuts in the flexible drive shaft 78 (see FIG. 8), which gives the flexible drive shaft 78 its flexibility and ability to be guided through with various radiuses of curvature inside the tubing, casing 36, and the deflecting device 42 of the downhole radial drilling system 40. At this point, the slider 82 is in the maximum extended position, at the bottom of the slider tube 84. Once the cutting bit 52 contacts the casing 36 and/or the formation 12, the flexible drive shaft 78 will compress, and the slider 82 will move up into the slider tube 84, and settle in a position commensurate with the amount of compression taking place on the flexible drive shaft 78. In this position, fluid flows through the fluid transfer hose 76 and through the hydraulic flow channels 86 of the slider 82, the slider 82 is in an upper position, the flexible drive shaft 78 is in the deflecting device 42 of the downhole radial drilling system 40, and the cutting bit 52 can start cutting through the casing layer(s).

Once the cutting bit 52 is through the casing 36 and into the formation 12, the downhole radial drilling system 40 may be pulled back and, at this stage, the slider 82 may move back to the lower position until the flexible drive shaft 78 is extended to the maximum. At this point, the entire downhole radial drilling system 40 may be retrieved from the wellbore 14, or another cutting operation may be started within the same wellbore 14.

Figure 10:
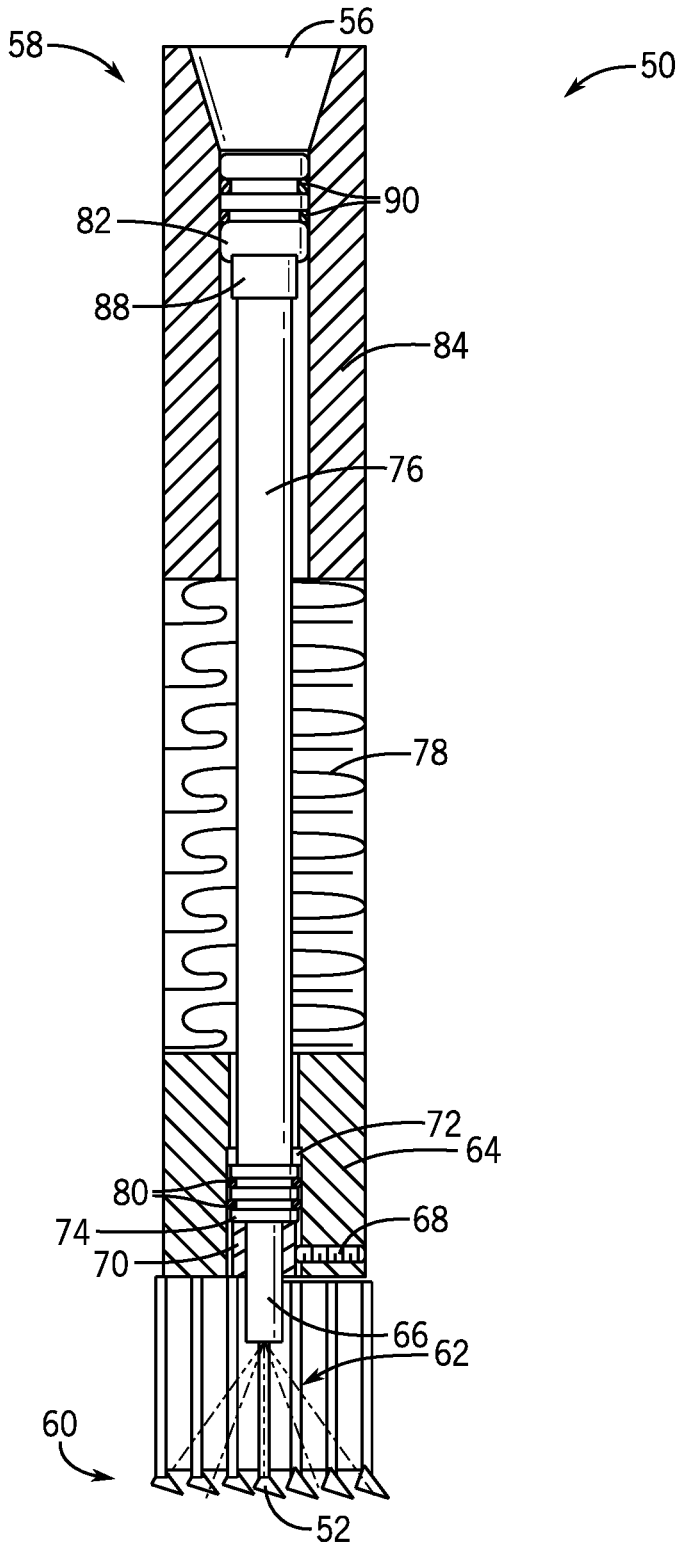
FIG. 10 is a cross-sectional view of an alternative flexible drilling assembly of the downhole radial drilling system, in accordance with embodiments of the present disclosure.
Figure 11:
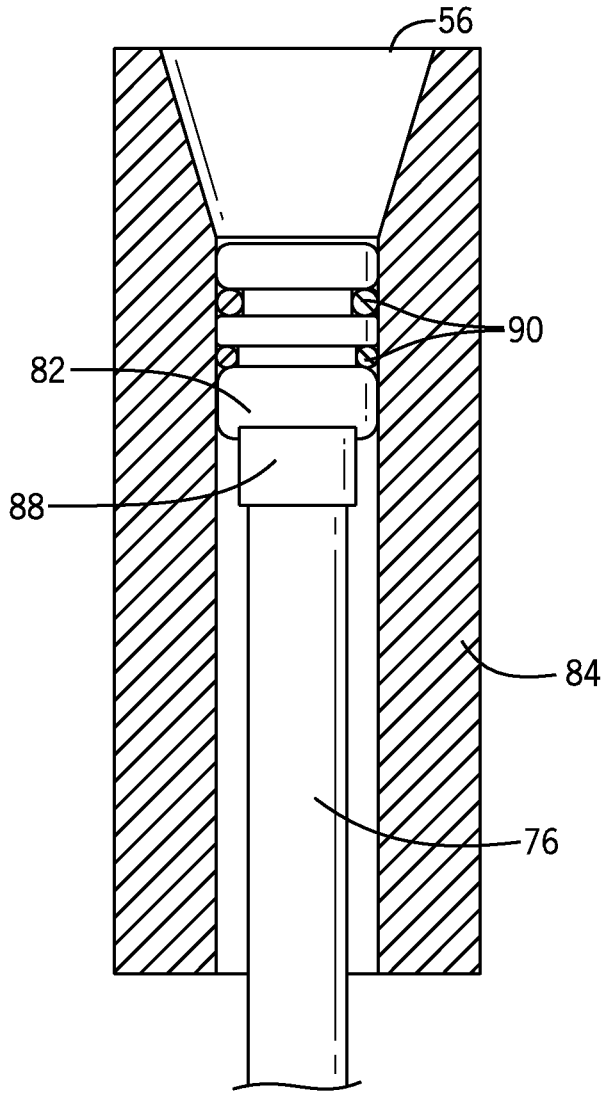
FIG. 11 is a cross-sectional view of a portion of a slider tube of the flexible drilling assembly of FIG. 10, in accordance with embodiments of the present disclosure.

Although primarily described herein as including a slider 82 that includes one or more hydraulic flow channels 86, in other embodiments, the slider 82 may instead include one or more sealing O-rings 90 disposed in corresponding ring grooves on an exterior of the slider 82, as illustrated in FIGS. 10 and 11. In such embodiments, the one or more sealing O-rings 90 may provide fluid sealing between the slider 82 and the slider tube 84.

The embodiments of the present disclosure advantageously provide for through-flow of cooling fluids and/or cleaning fluids to the cutting bit 52, provide the cutting bit 52 with the ability to penetrate a casing 36 and/or a formation 12, provide flexibility and more controlled drilling once outside of the casing 36 due to the compensation provided by the slider 82, and provide good torque transfer from the flexible drive shaft 78 to the cutting bit 52.

The specific embodiments described above have been illustrated by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The invention claimed is:

1. A drilling system, comprising:

a deflecting device comprising an internal passage extending therethrough; and a flexible drilling assembly configured to extend through the internal passage of the deflecting device, and to create a perforation lateral tunnel in a wellbore, wherein the flexible drilling assembly comprises:

a flexible drive shaft configured to rotate relative to the internal passage of the deflecting device;

a cutting bit disposed at a first axial end of the flexible drilling assembly;

a slider tube disposed at a second axial end of the flexible drilling assembly; and a slider radially disposed within the slider tube, wherein the slider is configured to compensate for expansion and compression of the flexible drive shaft while the perforation lateral tunnel is being created in the wellbore by the flexible drilling assembly, and wherein the slider comprises one or more hydraulic flow channels extending axially along an exterior surface of the slider to provide pressure compensation.

2. The drilling system of claim 1, wherein the slider is configured to slide axially within the slider tube to compensate for the expansion and compression of the flexible drive shaft.

3. The drilling system of claim 1, wherein the flexible drilling assembly comprises a motor sealing connection coupled to the slider tube at the second axial end of the flexible drilling assembly, wherein the motor sealing connection is configured to be driven by a power source.

4. The drilling system of claim 3, wherein the power source comprises electric power, hydraulic power, or pneumatic power.

5. The drilling system of claim 1, wherein the flexible drilling assembly comprises a fluid transfer hose disposed radially within the slider tube and the flexible drive shaft, wherein the fluid transfer hose is configured to provide a fluid to the cutting bit.

6. The drilling system of claim 5, wherein the fluid transfer hose is coupled to the slider.

7. The drilling system of claim 5, wherein the cutting bit comprises a plurality of flow channels disposed therethrough to receive the fluid.

8. The drilling system of claim 1, wherein the flexible drilling assembly comprises a bit box that connects the flexible drive shaft to the cutting bit.

9. The drilling system of claim 8, wherein the bit box comprises a piston configured to hermetically seal a bottom portion of the flexible drilling assembly, and a limiter configured to prevent axial movement of the piston.

10. The drilling system of claim 8, wherein the bit box comprises a plurality of flow channels disposed therethrough to convey a fluid to the cutting bit.

11. A flexible drilling assembly, comprising:

a flexible drive shaft;

a cutting bit disposed at a first axial end of the flexible drilling assembly;

a slider tube disposed at a second axial end of the flexible drilling assembly;

a slider radially disposed within the slider tube, wherein the slider is configured to slide axially within the slider tube to compensate for expansion and compression of the flexible drive shaft during operation of the flexible drilling assembly; and a fluid transfer hose disposed radially within the slider tube and the flexible drive shaft, wherein the fluid transfer hose is configured to provide a fluid to the cutting bit.

12. The flexible drilling assembly of claim 11, wherein the slider comprises one or more hydraulic flow channels extending axially along an exterior surface of the slider to provide pressure compensation.

13. The flexible drilling assembly of claim 11, comprising a motor sealing connection coupled to the slider tube at the second axial end of the flexible drilling assembly, wherein the motor sealing connection is configured to be driven by a power source.

14. The flexible drilling assembly of claim 13, wherein the power source comprises electric power, hydraulic power, or pneumatic power.

15. The flexible drilling assembly of claim 11, wherein the fluid transfer hose is coupled to the slider.

16. The flexible drilling assembly of claim 11, wherein the cutting bit comprises a plurality of flow channels disposed therethrough to receive the fluid.

17. The flexible drilling assembly of claim 11, comprising a bit box that connects the flexible drive shaft to the cutting bit.

18. The flexible drilling assembly of claim 17, wherein the bit box comprises a piston configured to hermetically seal a bottom portion of the flexible drilling assembly, and a limiter configured to prevent axial movement of the piston.

19. The flexible drilling assembly of claim 17, wherein the bit box comprises a plurality of flow channels disposed therethrough to convey a fluid to the cutting bit.

20. A drilling system, comprising:

a deflecting device comprising an internal passage extending therethrough; and a flexible drilling assembly configured to extend through the internal passage of the deflecting device, and to create a perforation lateral tunnel in a wellbore, wherein the flexible drilling assembly comprises:

a motor sealing connection disposed at a first axial end of the flexible drilling assembly, wherein the motor sealing connection is configured to be driven by a power source;

a slider tube coupled to the motor sealing connection;

a flexible drive shaft configured to rotate relative to the internal passage of the deflecting device;

a fluid transfer hose disposed radially within the slider tube and the flexible drive shaft;

a cutting bit disposed at a second axial end of the flexible drilling assembly, wherein the cutting bit comprises a first plurality of flow channels disposed therethrough to receive a fluid from the fluid transfer hose;

a bit box that connects the flexible drive shaft to the cutting bit, wherein the bit box comprises a second plurality of flow channels disposed therethrough to convey the fluid to the cutting bit from the fluid transfer hose; and a slider radially disposed within the slider tube, wherein the slider is coupled to the fluid transfer hose, and wherein the slider is configured to slide axially within the slider tube to compensate for expansion and compression of the flexible drive shaft while the perforation lateral tunnel is being created in the wellbore by the flexible drilling assembly, wherein the slider comprises one or more hydraulic flow channels extending axially along an exterior surface of the slider to provide pressure compensation.

* * * * *